US006081193A

United States Patent [19]

Trucchi et al.

[11] Patent Number: 6,081,193

[45] Date of Patent: Jun. 27, 2000

[54] ELECTRONIC INTRUSION DETECTION SYSTEM FOR MONITORED ENVIRONMENTS

[75] Inventors: Luciano Trucchi; Giovanni Negro, both of Turin, Italy

[73] Assignee: Tecno Alarm SNC Di Trucchi Luciano E Negro Giovanni, Turin, Italy

[21] Appl. No.: 09/068,889

[22] PCT Filed: Jul. 30, 1997

[86] PCT No.: PCT/EP97/04142

§ 371 Date: May 21, 1998

§ 102(e) Date: May 21, 1998

PCT Pub. Date: May 21, 1998

[51] Int. Cl.[7] ..... G08B 13/00

[52] U.S. Cl. ..... 340/541; 340/538; 340/554; 340/555; 340/692

[58] Field of Search ..... 340/541, 567, 340/555, 554, 511, 533, 538, 691.1, 691.2, 692, 384.3; 379/44; 381/56; 367/94; 342/28; 348/152–155

[56] References Cited

U.S. PATENT DOCUMENTS

| | | | |
|---|---|---|---|
| 4,060,803 | 11/1977 | Ashworth, Jr. | 340/521 X |
| 4,182,990 | 1/1980 | Coffin et al. | 340/691.5 X |
| 4,857,912 | 8/1989 | Everett, Jr. et al. | 340/541 X |
| 5,400,011 | 3/1995 | Sutton | 340/692 X |

FOREIGN PATENT DOCUMENTS

| | | | |
|---|---|---|---|
| 2611290 | 8/1988 | France . | |
| 2639745 | 6/1990 | France | 340/541 |
| 2665007 | 1/1992 | France | 340/541 |
| 2700046 | 7/1994 | France | 340/541 |
| 2064189 | 6/1981 | United Kingdom . | |

*Primary Examiner*—Thomas Mullen
*Attorney, Agent, or Firm*—Jackson Walker L.L.P.

[57] ABSTRACT

An electronic intrusion detection system for monitoring environments having at least one electronic sensor responsive to movements occurring in the environment and adapted to modify at least one characteristic of its electrical output in response to the presence of a moving body in the environment. An alarm is signaled when the modification meets a predetermined condition. A transducer is provided for continuously converting the modification of the output from the electric sensor into a signal that can be perceived by a human being. An alarm control unit connected to the alarm and transducer forwards the signals to the surveillance personnel through a telephone line.

15 Claims, 1 Drawing Sheet

ELECTRONIC INTRUSION DETECTION SYSTEM FOR MONITORED ENVIRONMENTS

TECHNICAL FIELD

The present invention relates to an electronic intrusion detection system for environments to be monitored.

More particularly the invention is concerned with an electronic remote surveillance device adapted to be employed in combination with monitoring apparatuses, alarm systems, fire alarm devices, antitheft systems, etc.

In the field of the alarm and antitheft systems for protecting civil dwellings and industrial premises there are known monitoring systems that use Doppler or infrared volumetric sensors.

The volumetric sensors based on Doppler effect are substantially small-size radar devices operating in the microwave spectrum, typically 1–10 GHz, capable of detecting a person moving even at an extremely low speed.

On the other hand the infrared volumetric sensors are sensors capable of detecting a temperature difference caused by the passage of a human body in the environment in which the sensors are located, but these sensors cannot detect mechanical vibrations.

In presence of a body moving inside the environment or the space to be monitored, the above mentioned volumetric sensors generate an electric signal that can be applied to a control circuit that in turn actuates alarm warning devices or other devices that draw attention to the event by means of acoustic and/or optical (visual) alarm messages.

BACKGROUND ART

In remotely manned monitoring systems, the acoustic and/or visual signal generated by the sensor(s) is converted into an alarm message and generally transmitted through a radio link or on a telephone line, either public or private, to a receiving device that can be located far away from the monitored place at which the event detection occurred.

As an example, the alarm message can be sent either to a receiving device located in a central control unit manned by private personnel or by policemen, or to a fixed or mobile telephone set, furnished to the surveillance personnel or even to the owner of a house.

The alarm message received through said devices can incorporate information relating to the place at which the event took place, such as for example a predetermined recorded vocal message.

When the person in charge of the surveillance receives such alarm message from a monitored environment, he/she can either directly intervene or arrange for proper actions, such as for example the request for a police intervention.

One of the main inconveniences of the known alarm systems using volumetric sensors that transmit alarm messages to a remote control unit is that the surveillance personnel—or more generally the person that receives such alarm message—is not in condition to discriminate a false alarm caused by a disturbance from a real alarm situation in which a quick intervention is required.

The likelihood of a false alarm is not an infrequent event in spite of the technical improvements to the conventional antitheft systems.

When infrared sensors are used in a monitoring system, many disturbing sources such as natural or artificial light sources, quick changes of temperature, e.g. caused by room convectors, sudden raise of the environment lighting due for example to the front lights of a passing car, are all capable of being detected by the sensors and generating (false) alarm signals. Moreover, the sensitivity of infrared sensors decreases when the environment temperature increases.

When Doppler sensors are used, false alarms can be triggered by electromagnetic disturbances and by accidental movements of objects like a banging door or a falling flowerpot.

Because the alarm message received at the remote location does not contain information allowing the personnel in charge to decide with certainty whether it is due to a real or a false alarm, such monitoring systems suffer from several drawbacks, such as delayed interventions, or unnecessary interventions, with a reduction of the system reliability.

For example, upon receiving an alarm message through his mobile phone, the owner of a dwelling that is far from home has to decide whether to ask for an intervention, or inform the police, or simply disregard the message as a false alarm, only on the basis of a generic alarm message he/she has received.

In the past several suggestions have been made in order to reduce the risk of false alarms, while attempting to still maintain the sensitivity of the sensors high.

One of the suggestions was to adjust the threshold level of the sensors to different conditions of the environment disturbances, another provided for pulse counters that actuated an alarm signal only after receiving a predetermined number of the sensor detections, more likely to be caused by the presence of an intruder moving within the protected enclosure.

Still another device provided for using a combination of Doppler and infrared sensors both of which had to be activated before an alarm message was generated.

However the above mentioned devices have not solved the problem of eliminating in the person receiving the alarm signal the uncertainty about its causes.

Namely it is known that alarm devices are not free from faults and malfuntions that can generate false alarms. Therefore, in the useful life of any alarm system a number of false alarms is to be considered as unavoidable.

Still with the aim of eliminating the uncertainity deriving from receiving an alarm signal, in the past there have been proposed devices that monitor the environment through a microphone or a television camera.

One of such devices is disclosed in FR-A-2 611 290 concerning an alarm device capable of transmitting an alarm message. The device illustrated and described in FR-A-2 611 290 comprises a volumetric sensor that upon being activated actuates a telephone dialing device which emits a predetermined stored number and transmits an alarm message through a telephone line.

At the end of the alarm message an environment hearing is started through a microphone that allows the remote listening of the sounds and noises within the monitored space.

However, the remote listening through microphones requires the installation of additional devices in the rooms to be monitored and does not allow the listening of low intensity noises, such as those caused by slow movements.

Moreover the background noise—due for example to the street traffic or to sound diffusing devices, such as radio and TV sets—is a strong source of disturbance to the remote listening through microphones, and can make impossible to distinguish between such noises and low intensity sounds caused by an intruder moving in the environment to be monitored.

A severe drawback to using microphones is set by law restrictions to environmental listening in force in some countries such as France, and anyhow such listening can be prolonged beyond given time limits.

The use of television cameras for visually monitoring at distance provides for a good perception of what is happening within the camera field of view, but at a very high cost, since at least one camera has to be installed in each of the rooms to be monitored, and the system further requires a receiving apparatus equipped with monitor(s) to display the images.

OBJECTS OF THE INVENTION

It is therefore an object of the present invention to realize an intrusion detection system capable of solving the technical problem of the uncertainty about the nature of an alarm message, such system being free from the above mentioned shortcomings of the prior art devices.

A further object of the present invention is to realize an intrusion detection system that is both reliable and easy and inexpensive to install and to use.

DISCLOSURE OF THE INVENTION

The above objects of the present invention are achieved through an intrusion detection system as claimed in claim 1.

Further objects of the invention are accomplished through an intrusion detection system as claimed in the dependent claims.

BRIEF DESCRIPTION OF THE DRAWING

The intrusion detection system of the present invention will be disclosed in detail with reference to the attached FIG. 1 that shows a block diagram illustrating a preferred but non limiting embodiment of the invention.

DETAILED DESCRIPTION OF PREFERRED EMBODIMENTS

Figure 1:
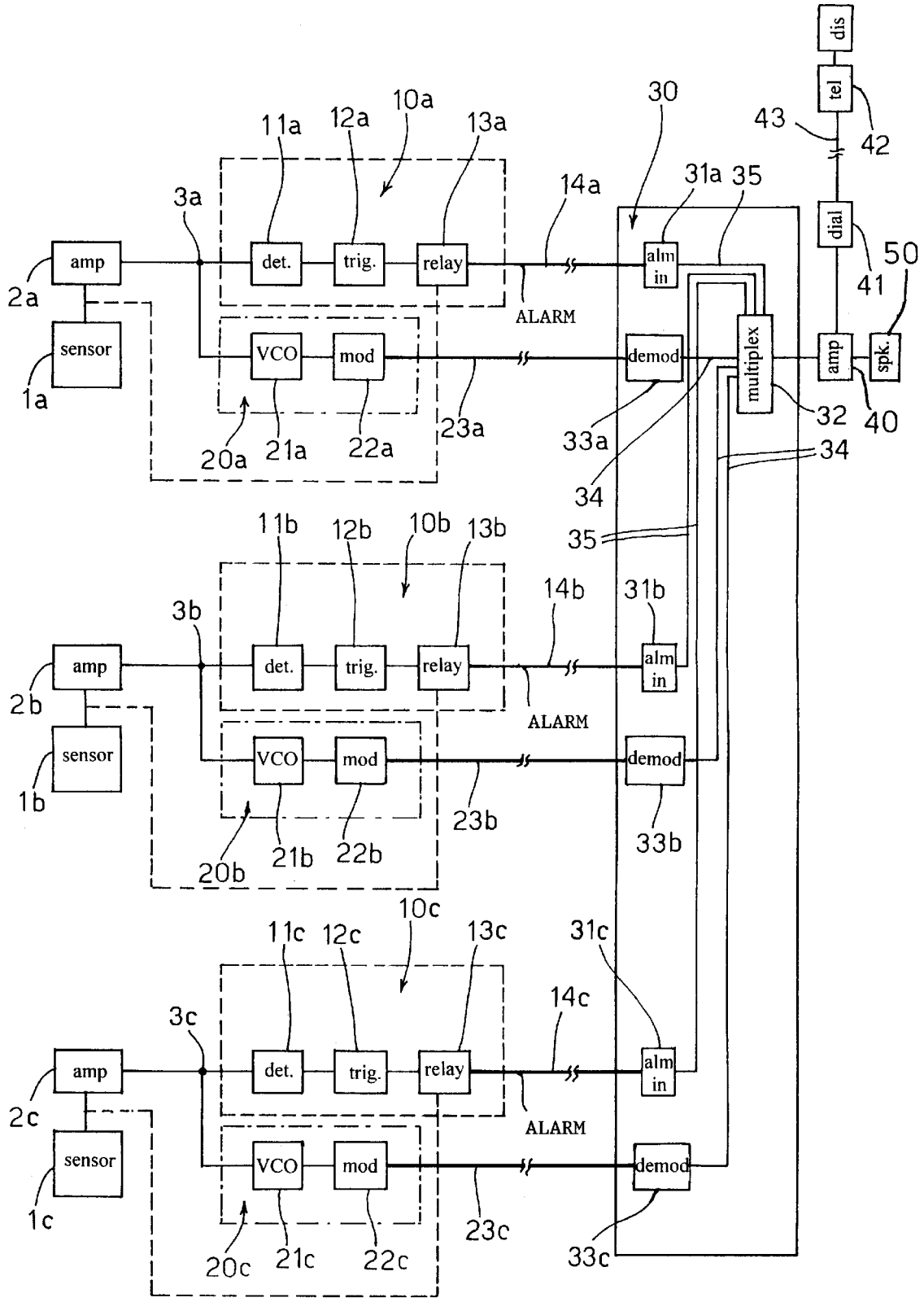

In the block diagram of the attached FIG. 1 there are illustrated the main components of an intrusion detection system in accordance with the teachings of the present invention. The system generally comprises a number of volumetric sensors 1*a,* 1*b,* 1*c* that can be positioned in the environment(s) to be monitored in accordance with different patterns, such as one sensor for each room or two or more properly arranged sensors inside each (or a single) room to be monitored to increase the area kept under surveillance, in accordance with known techniques.

The volumetric sensors 1*a,* 1*b* and 1*c* can be either infrared sensors or sensors detecting the frequency shift caused by Doppler effect, hereinafter referred to as Doppler sensors.

When a human body passes through their detection range, infrared sensors generate a change in their output voltage signal, whereas Doppler sensors generate a frequency change in the reflected signal (generated by a not shown source) that is proportional to the speed and to the direction of the movement.

The output signals from the volumetric sensors 1*a,* 1*b* and 1*c* are amplified by the analogical amplifiers 2*a,* 2*b* and 2*c,* the outputs of which are applied for further processing to the nodes or junction points 3*a,* 3*b,* 3*c,* respectively. More precisely, each node 3*a,* 3*b,* 3*c* is connected both to the input of an alarm generating circuit 10*a,* 10*b* and 10*c,* enclosed in a dashed box in the Figure, and to the input of a transducer or conversion circuit 20*a,* 20*b* and 20*c,* enclosed in a dash-and-point box in the Figure.

Each of the alarm circuits 10*a,* 10*b* and 10*c* outputs an alarm signal ALARM having a suitable voltage level when a predetermined alarm condition is met. In the illustrated embodiment of the invention, each of the alarm circuits 10*a,* 10*b* and 10*c* comprises a threshold detector (11*a,* 11*b,* 11*c*) connected a trigger circuit (12*a,* 12*b,* 12*c*) that actuates a relay (13*a,* 13*b,* 13*c*) or similar device that generates the alarm signal.

In the illustrated embodiment of the invention, the corresponding relay 13*a* (13*b,* 13*c*) that is actuated by the trigger circuit 12*a* (12*b,* 12*c*) driven by the threshold detector 11*a* (11*b,* l1*c*) supplies the alarm signal from said alarm circuit 10*a* (10*b,* 10*c*).

More precisely, when the signal level applied to the alarm circuit 10*a,* 10*b* and 10*c* is higher than a predetermined threshold level, then the corresponding relay 13*a,* 13*b* and 13*c* switches from a rest condition to an alarm condition and enables an alarm signal or message to be transmitted to the respective alarm input 31*a,* 31*b,* 31*c* of an alarm control unit 30 through an alarm signal transmission line 14*a,* 14*b,* 14*c.*

Through the alarm inputs 31*a,* 31*b,* 31*c,* a multiplexer or switch 32, provided in the alarm control unit 30, receives an ALARM signal having a proper logic level, e.g. 5 V for indicating a logic one, and about 0 V for indicating a logic zero, this signal representing the state of the sensor 1*a* or 1*b* or 1*c* that generated the alarm signal.

In the illustrated embodiment the conversion or transducer circuit 20*a,* 20*b* and 20*c* comprises a voltage controlled oscillator or VCO 21*a,* 21*b,* 21*c* respectively, whose oscillation range is maintained in the (audio) frequency band from 300 Hz to 3,000 Hz corresponding to the telephone speech band, and a modulating circuit 22*a,* 22*b,* 22*c* respectively.

In such conversion circuit 20*a* (20*b,* 20*c*), the amplified signal from the volumetric sensor 1*a* (1*b,* 1*c*) is used to drive the voltage controlled oscillator or VCO 21*a* (21*b,* 21*c*) and the output audio-frequency signal from the VCO is modulated in a modulating circuit 22*a* (22*b,* 22*c*) before being transmitted, on a transmission line for audio signals 23*a* (23*b,* 23*c*), to a demodulator 33*a* (33*b,* 33*c*) provided in the control unit 30.

This way any modification of the electric output from the sensors 1*a,* 1*b,* 1*c* is continuously converted into an audio signal, i.e. a signal that can be perceived (in the present case, heard) by a human being. This audible signal is correlated with the monitored environment, i.e. contains information about what's happening within the monitored space. When the sensors are infrared sensors this audible signal is a sort of "audio" picture of the thermal pattern changing in the monitored space. When the sensors are Doppler sensors, this audible signal "represents" the motions occurring within the monitored space. In both cases the listener can easily distinguish the audio signals caused by an intrusion from those caused by disturbances, such as temporary phenomena or periodic sounds such as those produced by a banging door.

In the alarm control unit 30 the output (audio) signal from demodulator 33*a,* 33*b,* 33*c* is applied to a corresponding input channel 34 of the multiplexer 32 the output of which is connected to an audio amplifier 40.

Each of the input channels 34 to the multiplexer 32 can be enabled to reach the audio amplifier 40 by a logic address fed to one of the addressing inputs 35 of the multiplexer 32, connected to the outputs of the relay 13*a,* 13*b,* 13*c,* respectively.

Through the multiplexer 32, one or more of the multiplexed audio signals are applied to the audio amplifier 40 the output of which feeds a telephone dialing device 41 (actuated by the alarm message) for the transmision on a public telephone line 43.

Through the public telephone network (not shown) the audio signals can be received by any selected telephone set 42 or equivalent receiving device available to the surveillance personnel.

More precisely, the alarm signal ALARM activates the telephone dialing device 41 for the setting up the connection with the receiving telephone set 42, and then the same signal enables the transmission along the telephone line 43 of an audio signal that is proportional to the activity detected by the volumetric sensor 1*a,* 1*b,* 1*c*.

This way it is possible to obtain a continuous monitoring of the movements that might occur in the environments under surveillance, regardless of the (background) noise generated therein.

According to an alternative embodiment, the above audio signal can be directly applied to a loudspeaker (50) disposed in the audible range of the surveillance personnel, such as for example the caretaker of a museum or other premises.

In accordance with another embodiment of the invention, each signal generated by the volumetric sensors is converted into a form adapted to drive a display (60) visible to the surveillance personnel, such as a CRT monitor, e.g. connected to the other end of the telephone line 43 and capable of visually representing the movements taking place in the monitored space, e.g. by changing the images shown. This way the watcher could get a graphic representation of the movements occurring in the monitored space. Such representation is not the visual display of a television camera, but is nevertheless capable of allowing an easy and positive discrimination between an intrusion and other phenomena.

In accordance with another embodiment of the invention, the signal generated by the volumetric (Doppler or infrared) sensor 1*a* (1*b,* 1*c*) is directly applied to the relay 13*a* (13*b,* 13*c*) which relay is generally incorporated in the same housing of the sensor. This embodiment is schematically shown in FIG. 1 by the dashed line connection between the output of amplifier 2*a* (2*b,* 2*c*) and the relay.

This way the signal to be modulated will be generated by the opening and closing in succession of the relay 13*a* (13*b,* 13*c*) driven by the volumetric sensor 1*a* (1*b,* 1*c*). The so obtained pulse signal has a period that is proportional to the relay opening/closing cycle, and therefore is representative of the detection activity of the volumetric sensor, but is more "clean" (that is contains less spurious signals) in respect of a signal directly coming from the sensor.

The above embodiment of the invention has further the advantage of a simpler construction since the transmission line 14*a,* 14*b,* 14*c*—provided for sending the ALARM signal—can be used also for transmitting the signal from the unit containing the volumetric sensor and the relay to the alarm control unit 30. The analysis for detecting when the threshold has been exceeded (i.e. an alarm condition) will be carried out downward of the relays 13*a,* 13*b,* 13*c,* and more precisely in the alarm control unit 30, by verifying the signal from the volumetric sensor as mediated by the solid state relay 13. In this embodiment the relays 13*a,* 13*b,* 13*c* are advantageously formed by solid state relays that are more suitable to be continuously closed and opened at a high rate.

According to still another embodiment of the invention, the signal transmitted on audio transmission line 23*a* (23*b,* 23*c*) to the control unit 30 is continuously stored in a memory device provided for in this unit. Preferably, such memory device is a solid state memory capable of continuously storing an interval or "frame" of the signal. Preferably unit 30 will contain a plurality of memory devices, each one for storing the signal from one of the sensors located in the monitored environment.

According to this embodiment, the stored signal can be transmitted along the telephone line to the surveillance personnel immediately after the transmission of an ALARM signal that has warned the personnel of a possible alarm condition. Since the signal that caused the alarm has been stored, the surveillance personnel will have the additional possibility of listening to the signal—converted into audible form—that caused the alarm. However, once the stored signal has been transmitted, the system will start to transmit the current or real time signal so that the personnel can monitor what is happening in the monitored environment.

Through the disclosed device, the movements can be displayed even without triggering any alerting signal, by sequentially enabling the channels of multiplexer 32, either manually or electronically.

This way the surveillance personnel can listen to or look at the movements occurring in the monitored rooms, regardless of an alerting signal being generated or not, and regardless of the noise generated in the monitored room.

Industrial Applicability

The invention is applicable in the field of the alarm and antitheft systems for protecting civil dwellings and industrial premises from intrusion through a remote surveillance.

What is claimed is:

1. An electronic intrusion detection system for at least one monitored environment, comprising:

at least one electronic sensor (1*a,* 1*b,* 1*c*) responsive to movements occurring in said environment and capable of modifying at least one of the significant characteristics of its output electric signal in response to the presence of a moving body in said monitored environment;

at least a first alarm circuit (10*a,* 10*b,* 10*c*) connected to said sensor and capable of generating an alarm signal (ALARM) when said modification meets a predetermined condition;

and an alarm control unit (30) adapted to receive said alarm signal (ALARM);

characterized in that said system comprises additional transducer means (20*a,* 20*b,* 20*c*) for continuously converting said modification of the output from said electric sensor (1*a,* 1*b,* 1*c*) into a signal that can be perceived by a human being, said perceivable signal being transmitted to said alarm control unit (30).

2. A system as claimed in claim 1, characterized in that said transducer means (20*a,* 20*b,* 20*c*) for continuously converting said modification of the output from the electric sensor (1*a,* 1*b,* 1*c*) into a signal that can be perceived by a human being comprises a frequency generator (21*a,* 21*b,* 21*c*) controlled by said modified characteristics of the electric output signal from said sensor (1*a,* 1*b,* 1*c*), and an acoustic transducer disposed in the audible range of the surveillance personnel.

3. A system as claimed in claim 2, characterized in that said frequency generator (21*a,* 21*b,* 21*c*) comprises an audio-frequency generator.

4. A system as claimed in claim 3, characterized in that said audio-frequency generator (21*a,* 21*b,* 21*c*) comprises a voltage controlled oscillator or VCO with the frequency of the signal generated by said oscillator (21*a,* 21*b,* 21*c*) being comprised between 300 and 3,000 Hz.

5. A system as claimed in claim 3, characterized in that said transducer means (20*a,* 20*b,* 20*c*) further comprises a modulating circuit 22*a* (22*b,* 22*c*).

6. A system as claimed in claim 5, characterized in that said alarm circuits (10*a,* 10*b,* 10*c*) are connected to said alarm control unit (30) by signal transmission lines (14*a,* 14*b,* 14*c*), and in that said alarm control unit (30) comprises demodulating means (33*a,* 33*b,* 33*c*) and alarm inputs (31*a,* 31*b,* 31*c*).

7. A system as claimed in claim 6, characterized in that said alarm control unit (30) comprises a switching device or a multiplexer (32) having a plurality of input channels (34) each carrying the audio-frequency signal obtained from one of said transducer means (20*a,* 20*b,* 20*c*), and a plurality of addressing inputs (35), each connected to one of said alarm inputs (31*a,* 31*b,* 31*c*) for enabling said switching means (32) to output the audio-frequency signals associated with an alarm signal.

8. A system as claimed in claim 7, characterized in that the output of said switching device (32) is connected to an amplifier (40) the output of which feeds a telephone dialing device (41) for the transmision of the alarm signals and the audio-frequency signals through a telephone line (43) to a receiving telephone set (42).

9. A system as claimed in claim 8, characterized in that said transducer means (20*a,* 20*b,* 20*c*) for continuously converting said modification of the output from the electric sensor (1*a,* 1*b,* 1*c*) into a signal that can be perceived by a human being comprises a frequency generator (21*a,* 21*b,* 21*c*) controlled by said modified characteristics of the electric output signal from said sensor (1*a,* 1*b,* 1*c*), and a display (60) connected to the telephone line (43 visible to the surveillance personnel, said display (60) capable of visually representing the movements occurring in the monitored space.

10. A system as claimed in claim 7, characterized in that the output of said switching device (32) is connected to an amplifier (40) the output of which feeds an acoustic transducer (50) disposed in the audible range of the surveillance personnel.

11. A system as claimed in claim 1, characterized in that said at least one sensor (1*a,* 1*b,* 1*c*) is selected from the group of infrared sensors, Doppler effect sensors or a combination thereof.

12. A system as claimed in claim 1, characterized in that the output of said sensor (1*a,* 1*b,* 1*c*) is directly coupled to a corresponding relay (13*a,* 13*b,* 13*c*), whereby the signal to be modulated is generated by the opening and closing in succession of said relay (13*a,* 13*b,* 13*c*) driven by the signal from said volumetric sensor (1*a,* 1*b,* 1*c*).

13. A system as claimed in claim 12, characterized in that said relay (13*a,* 13*b,* 13*c*) is enclosed in the same unit housing said sensor (1*a,* 1*b,* 1*c*) and the signal from said unit is transmitted to the alarm control unit (30) along the same transmission line (14*a,* 14*b,* 14*c*) provided for sending said alarm signal (ALARM).

14. A system as claimed in claim 1, characterized in that the signal transmitted to the control unit (30) is continuously stored in at least one memory device in said control unit (30).

15. A system as claimed in claim 14, characterized in that each of said at least one memory device is a solid state memory capable of continuously storing an interval of the signal, and there is provided one memory device for storing the signal from each sensor located in the monitored environment.

* * * * *